United States Patent [19]

Boonstra et al.

[11] 4,415,486

[45] Nov. 15, 1983

[54] RESISTIVE PASTE FOR A RESISTOR BODY

[75] Inventors: Alexander H. Boonstra; Cornelis A. H. A. Mutsaers; Franciscus N. G. R. van der Kruijs, all of Eindhoven, Netherlands

[73] Assignee: U.S. Philips Corporation, New York, N.Y.

[21] Appl. No.: 383,365

[22] Filed: Jun. 1, 1982

[30] Foreign Application Priority Data

Jun. 11, 1981 [NL] Netherlands ..... 8102809

[51] Int. Cl.[3] ..... H01B 1/02

[52] U.S. Cl. ..... 252/514; 252/518; 338/308; 338/309; 428/432

[58] Field of Search ..... 252/514, 518; 428/209, 428/432, 433, 434, 308, 309, 328, 357, 379, 403; 106/1.23, 53, 1.24, 54; 338/308, 309, 312, 314, 20, 21

[56] References Cited

U.S. PATENT DOCUMENTS

| | | | |
|---|---|---|---|
| 3,851,228 | 11/1974 | Sheard | 252/514 |
| 3,857,798 | 12/1974 | Wall et al. | 252/514 |
| 3,876,560 | 4/1975 | Kuo et al. | 252/514 |
| 3,914,514 | 10/1975 | MacKenzie et al. | 252/514 |
| 4,001,146 | 1/1977 | Horowitz | 252/514 |
| 4,184,192 | 1/1980 | Yoshida et al. | 252/514 |
| 4,186,423 | 1/1980 | Yoshida et al. | 252/514 |
| 4,286,251 | 8/1981 | Howell | 252/514 |

*Primary Examiner*—Josephine Barr

*Attorney, Agent, or Firm*—Norman N. Spain

[57] ABSTRACT

Resistive paste for manufacturing a resistor body by means of screen-printing the paste on a substrate, followed by firing. The paste comprises a silver-palladium alloy, a metal oxidic compound which contains either PdO and/or can react therewith, a permanent and a temporary binder. The metal oxidic compound may be provided as a layer on the AgPd particles or be mixed therewith. The result is a low-ohmic resistor having a $|TRC| < 100 \times 10^{-6}/°C.$ in the range from $-60°$ to $+200°$ C.

4 Claims, No Drawings

RESISTIVE PASTE FOR A RESISTOR BODY

The invention relates to a resistive paste for a resistor body, consisting of a mixture of a silver-palladium alloy, a metal oxidic compound, a permanent binder and a temporary binder, and to a resistor consisting of a substrate bearing such a resistive coating from which connection leads extend, the resistive coating having been formed by heating such a resistive paste on the substrate so as to remove the temporary binder and producing a coherent coating.

Electrical conduction properties of Ag-Pd-alloys are known from an article by T. Ricker in Z. Metallk, 54 718–724 (1963).

Resistor bodies can be formed from said alloys in combination with a vitreous binder. These resistor bodies have values in the low-ohmic range (approximately 0.1–30 Ohm) with a temperature coefficient of the resistance $|TRC| < 100 \times 10^{-6}/°C.$ in the temperature range from −60° to +200° C. During manufacture of said resistor bodies a firing temperature above 850° C. must preferably be chosen, as below this temperature palladium oxide PdO is formed. Palladium oxide has a semiconductor resistance behaviour with a negative temperature coefficient of resistance. The level of the firing-temperature and the duration of the firing operation determine the ratio of palladium oxide formed and consequently the value of the temperature coefficient of resistance. In addition, the formation of palladium oxide also causes a modification of the composition of the Pd-Ag-alloy which causes a considerable change of the temperature coefficient. All this means that at a firing temperature below 850° C. a Pd-Ag resistor cannot be obtained in a reproducible manner.

The invention provides a resistive paste for a resistor body which can be worked at a temperature between 650° and 850° C. to form resistor bodies having values in the range from 0.1–30 Ohm with a temperature coefficient of resistance $|TCR| < 100 \times 10^{-6}/°C.$ in the temperature range between −60° C. and +200° C.

According to the invention, the resistive paste for a resistor body, based on a silver palladium alloy is characterized in that the particles of the alloy are in intimate contact with a metal oxidic compound comprising palladium oxide PdO, and/or a metal oxidic compound which is capable of reacting with palladium oxide. This contact may consist in that the alloy is mixed with the metal oxidic compound or in that the alloy particles are coated with a metal oxidic compound which is capable of reacting with palladium oxide.

An attractive embodiment consists in that particles of the Ag-Pd-alloy are coated with a layer of a metal oxidic compound which comprises palladium oxide and/or a metal oxidic compound which is capable of reacting with palladium oxide.

In accordance with a further embodiment of the invented resistive paste, the particles of the Ag-Pd-alloy are coated with a layer of palladium rhodite $PdRhO_2$.

The presence of the thin, electrically conducting surface layer and of the metal oxidic compound mixed with the alloy, respectively results in a desired and constant temperature coefficient of resistance (TCR). Uncontrolled formation of palladium oxide cannot occur with the particles in accordance with the invention. The thin surface layer has a thickness of 0.001–0.1μm and may be provided on the particles by, for example, heating Rh $(OH)_3$ formed from a soluble Rh-compound, such as Rh-nitrate, to 600°–850° C., either prior to or simultaneously with the preparation of the resistor body.

Both silver and palladium have a positive TCR; the TCR of alloys has a minimum value at approximately the molar composition $Pd_{56}Ag_{44}$. Also the metal oxidic surface layer and the oxidic compound mixed with the alloy, both have a low positive TCR. There is an exchange of silver atoms for palladium both between the core of the particles and the surface layer, and between the metallic and the oxidic particles. The equilibrium achieved depends inter alia on the concentration of the silver atoms in the metal particles. Because of the exchange of palladium atoms for silver atoms in the surface layer, the temperature coefficient of resistance of this layer shifts in the negative direction. The core of the metal particles simultaneously obtains a more positive TCR, at least in the case in which the Ag content is beyond the minimum of 44 mole %. So the total value of the TCR can be controlled by the choice of the alloy composition in the core.

In, for example, the case of $PdRhO_2$-coated AgPd particles, this results in a decrease of the palladium content of the alloy from 56% by weight to 10% by weight which, since the price of Pd is much higher than that of Ag results in a considerable saving.

In addition, due to the presence of a metal oxidic surface layer on the alloy particles, there is a much lower reactivity between the particles. Consequently, during the firing process during the preparation of resistor bodies, the particles in the conductive paste remain much smaller than in the prior art resistors on the basis of a Pd-Ag alloy. Also this may result in a considerable saving in material, since a predetermined resistance value requires a smaller quantity of alloying material.

A very attractive embodiment is an embodiment in which the resistance-determining component of the resistive paste consists of $Ag_xPd_{1-x}RhO_2$. The TCR may be adjusted ad libitum by the choice of x.

This compound may, of course, also be mixed with AgPd and a permanent binder.

The invention will now be further described by way of example with reference to some embodiments.

EXAMPLE 1

A pulverulent alloy containing in a percentage by weight 70 Ag and 30 Pd is stirred in water. A solution of palladium nitrate and rhodium nitrate is added, in which the weight ratio Pd:Rh=1:1. The quantity is such that Rh:AgPd has a ratio by weight of 1:20.

The $Pd^{2+}$ and the $Rh^{3+}$ are quantitatively deposited as hydroxide onto the AgPd particles by means of a solution of tetramethylammonium hydroxide of which such a quantity is added that the solution has reached a pH=8. The prepared particles are removed by filtering and are dried at a temperature of 200° C.

Thereafter a paste is made of the powder in combination with glass powder having a composition in mol.%

| | |
|---|---|
| PbO | 42 |
| $SiO_2$ | 45.7 |
| $B_2O_3$ | 9.5 |
| $Al_2O_3$ | 2.9 |

in a molar ratio 1:1 with the aid of a binder consisting of ethyl cellulose dissolved in a 1:4 (weight ratio) mixture of butanol-1 and butylcarbitol acetate. The paste is spread on a substrate of aluminium oxide and the whole assembly is fired for 20 minutes at a temperature of 725° C. in air. The resistor body thus obtained has a resistance value of 10 Ohm/square and has a temperature coefficient of resistance (TCR) of $-20\times10^{-6}$/°C. in the range from −60 ° to +200° C.

EXAMPLE 2

Pulverulent silver-palladium comprising 80% by weight of Ag and 20% by weight of Pd is stirred in water and such a quantity of a solution of rhodium nitrate in water is added to this suspension that the suspension contains 2% by weight of Rh of the total Rh+silver-palladium. The rhodium ion is quantitatively deposited in the form of rhodium hydroxide onto the silver-palladium particles by means of tetraethyl ammonium hydroxide. After the particles have been separated from the liquid by means of filtering and have been dried, they are made into a paste with the glass powder of example 1, in a ratio by weight of 1:1, the same binder as in Example 1 being used. The paste is spread on an $Al_2O_3$ substrate and the assembly is fired for 15 minutes at 725° C. in air. The resistor body thus obtained has a resistance value of 5 Ohm/square and a TCR of $+50\times10^{-6}$/°C. in the range from −60° to +200° C.

EXAMPLE 3

The compounds $Ag_xPd_{1-x}RhO_2$, with different values of x, as indicated in Table I, are prepared from a mixture of the metal by firing the mixture for 2 hours at 650° C. in air. The powder obtained is made into a paste together with glass powder having the composition recited in Example 1, by means of the same binder as used in example 1. The paste is spread on aluminum oxide plates and the assembly is fired for 15 minutes at a temperature of 800° C. in air. The following Table I shows the results for some values of x.

TABLE I

| Resistance material | resistance value in Ohm/square | TRC ($10^{-6}$/°C.) |
|---|---|---|
| $PdRhO_2$ | 15 | +550 |
| $Ag_{0,05}Pd_{0,95}RhO_2$ | 10 | +280 |
| $Ag_{0.1}Pd_{0.9}RhO_2$ | 10 | −50 |

TABLE I-continued

| Resistance material | resistance value in Ohm/square | TRC ($10^{-6}$/°C.) |
|---|---|---|
| $Ag_{0.15}Pd_{0.85}RhO_2$ | 15 | −450 |

EXAMPLE 4

A pulverulent alloy having a composition in a percentage by weight of 70 Ag and 30 Pd is milled with glass powder having the composition stated in Example 1. Different quantities of the compound $Ag_{0.1}Pd_{0.9}RhO_2$ are added to portions of the mixture, and milled again thereafter.

After working in the customary manner, the paste prepared with the aid of the binders described in Example 1 and using aluminium oxide as the substrate material furnished the following results after firing for 15 minutes at 750° C. in air.

TABLE II

| Resistance material | resistance value in Ohm/square | TCR ($10^{-6}$/°C.) |
|---|---|---|
| AgPd + glass + 0% $Ag_{0.1}Pd_{0.9}RhO_2$ | 1.2 | +250 |
| AgPd + glass + 5% $Ag_{0.1}Pd_{0.9}RhO_2$ | 1 | +180 |
| AgPd + glass + 10% $Ag_{0.1}Pd_{0.9}RhO_2$ | 0.9 | +100 |
| AgPd + glass + 20% $Ag_{0.1}Pd_{0.9}RhO_2$ | 0.8 | +50 |
| AgPd + glass + 30% $Ag_{0.1}Pd_{0.9}RhO_2$ | 0.9 | −50 |

What is claimed is:

1. A resistive material suitable for the production of a resistor body consisting of a mixture of glass powder and a silver-palladium composition selected from the group consisting of a silver palladium rhodite compound of the formula $Ag_x\ P_{1-x}\ RhO_2$ wherein $0.05\leqq x\leqq0.15$, a mixture of alloys consisting of silver and palladium and said compound, and alloys consisting of silver and palladium the particles of which are coated with palladium rhodite of the formula $Pd\ RhO_2$.

2. A resistive paste as claimed in claim 1, characterized in that the particles of the Ag-Pd alloy are coated with a layer of palladium rhodite $PdRhO_2$.

3. A resistive paste as claimed in claim 1, characterized in that said paste comprises the compound $Ag_xPd_{1-x}RhO_2$.

4. A resistor consisting of an aluminum oxide substrate at least one surface of which is provided with a coating of the resistive material of claim 1 and conductive leads extending from said coating.

* * * * *

UNITED STATES PATENT AND TRADEMARK OFFICE

CERTIFICATE OF CORRECTION

PATENT NO. : 4,415,486

DATED : November 15, 1983

INVENTOR(S) : ALEXANDER H. BOONSTRA ET AL

It is certified that error appears in the above-identified patent and that said Letters Patent is hereby corrected as shown below:

In the Claims:

Column 4, Claim 1, Line 36

"P" should be --Pd--.

Signed and Sealed this

*Thirteenth* Day of *March 1984*

[SEAL]

*Attest:*

GERALD J. MOSSINGHOFF

*Attesting Officer*

*Commissioner of Patents and Trademarks*